US011859325B2

(12) United States Patent
Snook

(10) Patent No.: US 11,859,325 B2
(45) Date of Patent: Jan. 2, 2024

(54) LAUNDRY WASHING MACHINE WITH BIASED VARIABLE LENGTH AGITATOR

(71) Applicant: Midea Group Co., Ltd., Foshan (CN)

(72) Inventor: Bryan T. Snook, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 45 days.

(21) Appl. No.: 17/541,504

(22) Filed: Dec. 3, 2021

(65) Prior Publication Data

US 2023/0175185 A1 Jun. 8, 2023

(51) Int. Cl.

| | |
|---|---|
| ***D06F 13/04*** | (2006.01) |
| ***D06F 13/02*** | (2006.01) |
| ***D06F 21/08*** | (2006.01) |

(52) U.S. Cl.

CPC ..... *D06F 13/04* (2013.01); *D06F 13/02* (2013.01); *D06F 21/08* (2013.01)

(58) Field of Classification Search

CPC ..... D06F 13/02; D06F 13/04; D06F 21/08
See application file for complete search history.

(56) References Cited

U.S. PATENT DOCUMENTS

| | | | | |
|---|---|---|---|---|
| 1,869,590 | A | 8/1932 | Voss | |
| 3,245,235 | A | 4/1966 | Long | |
| 3,641,791 | A | 2/1972 | Wine et al. | |
| 5,473,915 | A * | 12/1995 | Hur | D06F 17/10 68/134 |
| 5,675,996 | A * | 10/1997 | Cho | D06F 17/10 68/134 |
| 6,481,248 | B2 | 11/2002 | Willis | |
| 10,787,761 | B2 | 9/2020 | Czarnecki et al. | |
| 2021/0062382 | A1 | 3/2021 | Andrejczuk et al. | |
| 2022/0259784 | A1* | 8/2022 | Hershler | D06F 21/08 |

FOREIGN PATENT DOCUMENTS

| | | | | |
|---|---|---|---|---|
| BR | 102012001746 | A2 | 9/2013 | |
| GB | 2308604 | A * | 7/1997 | D06F 15/00 |

OTHER PUBLICATIONS

Whirlpool, Top Load Washer with 2 in 1 Removable Agitator, Retrieved from: https://www.whirlpool.com/laundry/washers/top-load/p.5.2-5.3-cu.- ft.-top-load-washer-with-2-in-1-removable-agitator.wtw8127lc.html, Retrieved on Oct. 25, 2021.

* cited by examiner

*Primary Examiner* — Joseph L. Perrin
(74) *Attorney, Agent, or Firm* — Gray Ice Higdon

(57) ABSTRACT

A laundry washing machine includes a variable length agitator that is configurable in multiple configurations that provide different lengths for the agitator along its axis of rotation, and that is further biased to at least one of the configurations to facilitate user reconfiguration of the agitator.

22 Claims, 4 Drawing Sheets

LAUNDRY WASHING MACHINE WITH BIASED VARIABLE LENGTH AGITATOR

BACKGROUND

Laundry washing machines are used in many single-family and multi-family residential applications to clean clothes and other fabric items. Due to the wide variety of items that may need to be cleaned by a laundry washing machine, many laundry washing machines provide a wide variety of user-configurable settings to control various aspects of a wash cycle such as water temperatures and/or amounts, agitation, soaking, rinsing, spinning, etc. Nonetheless, the wash tubs of conventional laundry washing machine designs are generally of a single configuration, regardless of the types of loads being washed. Top-load washing machines, for example, often include an agitator or impeller that projects upwardly from the bottom of the wash tub and rotates about a vertical axis to agitate the load and/or the wash fluid in the wash tub to enhance washing performance. With some types of loads, however, the agitator is of less value, and in some instances, can make it more difficult to load and/or unload the washing machine. Bulky items such as blankets, comforters, and other bed linens, for example, do not benefit from the use of an agitator or impeller, and in many instances can be difficult to load and unload due to the presence of a body that projects upwardly in the center of the wash tub.

A need therefore exists in the art for a manner of customizing the physical configuration of a wash tub of a laundry washing machines to adapt to different types of loads.

SUMMARY

The invention addresses these and other problems associated with the art by providing a laundry washing machine and variable length agitator therefor that is configurable in multiple configurations that provide different lengths for the agitator along its axis of rotation, and that is further biased to at least one of the configurations to facilitate user reconfiguration of the agitator.

Therefore, consistent with one aspect of the invention, a laundry washing machine may include a housing, a wash tub disposed within the housing, and a variable length agitator disposed within the wash tub and configured to rotate about an axis of rotation, the variable length agitator being configurable in at least first and second configurations that respectively provide first and second lengths for the variable length agitator along the axis of rotation, and the variable length agitator including a bias mechanism configured to bias the variable length agitator towards the first configuration.

In some embodiments, the variable length agitator is further configurable in a third configuration that provides a third length for the variable length agitator along the axis of rotation that is intermediate the first and second lengths. Also, in some embodiments, the axis of rotation is substantially vertical and the laundry washing machine is a top-load laundry washing machine. Further, in some embodiments, the first length is longer than the second length, while in some embodiments, the first length is shorter than the second length. In addition, in some embodiments, the bias mechanism includes a spring, and in some embodiments, the spring is a coiled compression spring.

In addition, in some embodiments, the variable length agitator further includes a locking mechanism configured to selectively lock the variable length agitator in at least one of the first and second configurations. Moreover, in some embodiments, the locking mechanism is configured to selectively lock the variable length agitator in the second configuration. In some embodiments, the variable length agitator is unlockable in the first configuration. Moreover, in some embodiments, the locking mechanism is configured to selectively lock the variable length agitator in the first configuration. In some embodiments, the locking mechanism is configured to selectively lock the variable length agitator in each of the first and second configurations.

In addition, in some embodiments, the variable length agitator includes first and second members, and the first member is moveable relative to the second member along the axis of rotation to vary the length of the variable length agitator along the axis of rotation. In some embodiments, the locking mechanism is configured to automatically engage when the first and second members are moved to a predetermined relative position. Moreover, in some embodiments, the locking mechanism is configured to release in response to user actuation of the locking mechanism.

Also, in some embodiments, the locking mechanism includes a latch member disposed on one of the first and second members and a lip disposed on the other of the first and second members, and the latch member and the lip are configured to engage with one another and restrict relative movement between the first and second members when the first and second members are in a predetermined relative position. In some embodiments, the latch member includes an actuation surface that, when manipulated by a user, releases the latch member from the lip to permit relative movement between the first and second members. In addition, in some embodiments, the locking mechanism further includes an actuator member including an actuation surface that, when manipulated by a user, causes the actuator member to release the latch member from the lip to permit relative movement between the first and second members.

Also, in some embodiments, the locking mechanism includes a rotatable actuator configured to rotate about the axis of rotation to selectively lock and/or unlock the locking mechanism. In addition, some embodiments may further include a damping mechanism coupled between the first and second members and configured to limit a rate of relative movement between the first and second members. Further, in some embodiments, the first member is a tower member and the second member is a base member, and the base member includes a channel configured to receive a portion of the tower member.

Consistent with another aspect of the invention, a variable length agitator configured to rotate about an axis of rotation in a wash tub of a laundry washing machine may include first and second members, where the first member is moveable relative to the second member along the axis of rotation to selectively configure the variable length agitator in at least first and second configurations that respectively provide first and second lengths for the variable length agitator along the axis of rotation, and a bias mechanism configured to bias the variable length agitator towards the first configuration.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Embodiments consistent with the invention may be used to adapt the physical configuration of a wash tub of a laundry washing machine through manipulation of a variable length agitator that is further biased to a particular configuration, e.g., through a spring or other bias mechanism, to facilitate user manipulation of the agitator.

Figure 1:
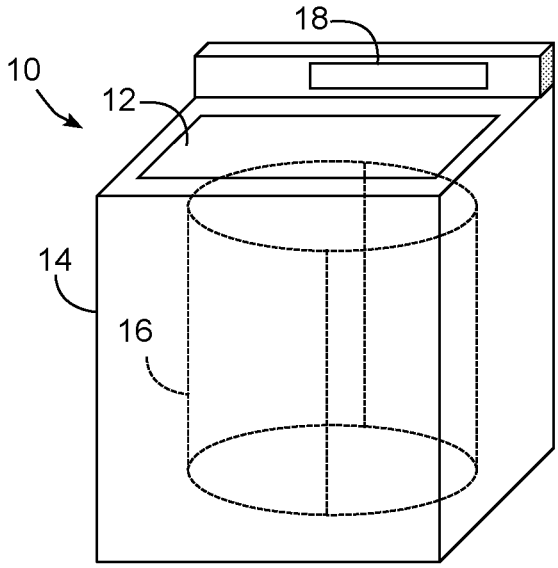
FIG. 1 is a perspective view of a top-load laundry washing machine consistent with some embodiments of the invention.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
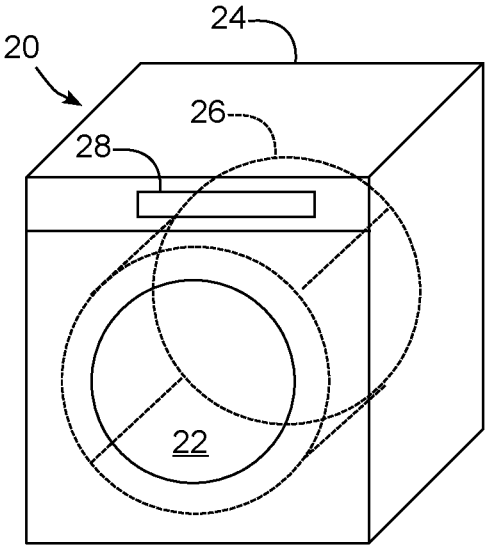
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques within a front-load laundry washing machine would be well within the abilities of one of ordinary skill in the art having the benefit of the instant disclosure, so the invention is not limited to the top-load implementation discussed further herein.

Figure 3:
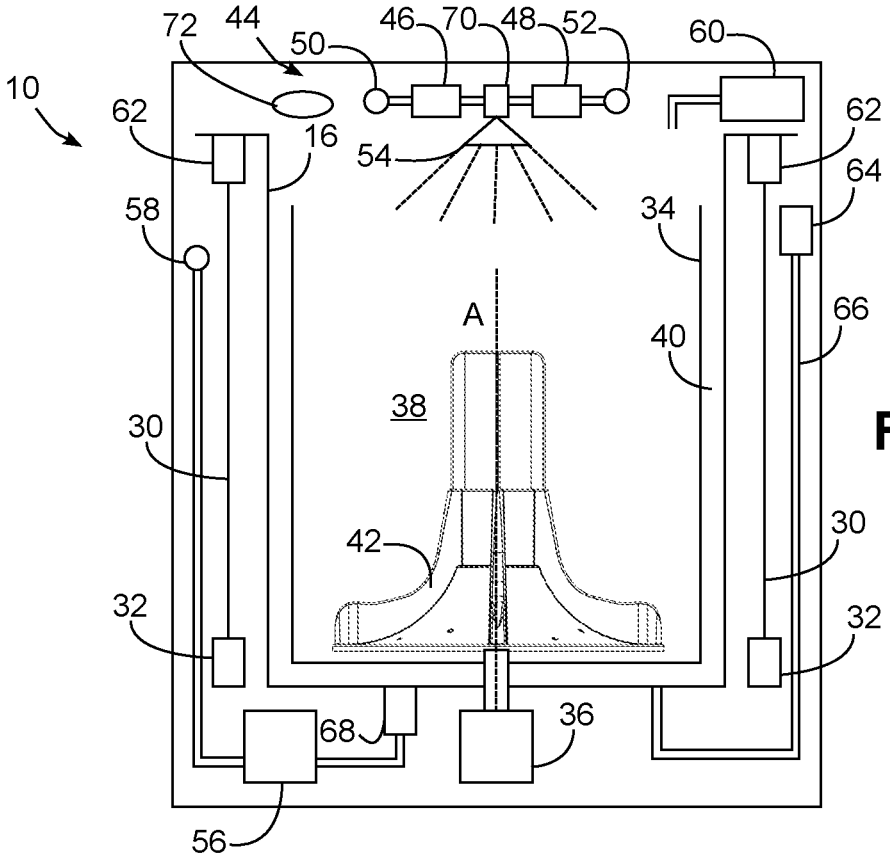
FIG. 3 is a functional vertical section of the laundry washing machine of FIG. 1.

FIG. 3 functionally illustrates a number of components in laundry washing machine 10. Wash tub 16 is vertically oriented, generally cylindrical in shape, opened to the top and capable of retaining water and/or wash liquor dispensed into the washing machine. Wash tub 16 may be supported by a suspension system such as a set of support rods 30 with corresponding vibration dampening springs 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, an agitator 42, also referred to as an impeller, auger or other agitation element (collectively referred to hereinafter as an agitator) may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42. As will become more apparent below, agitator 42 may be a biased variable length agitator capable of being configured with multiple lengths along an axis of rotation thereof.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16. In some embodiments, it may be desirable to utilize multiple nozzles 54, and in some instances, oscillating nozzles 54, such that water dispensed into the wash tub is evenly distributed over the top surface of the load. As will become more apparent below, in some instances, doing so may maximize the amount of water absorbed by the load prior to water reaching the bottom of the wash tub and being sensed by a fluid level sensor.

In some embodiments, laundry washing machine 10 may also include a dispensing system 60 configured to dispense detergent, fabric softener and/or other wash-related products into wash tub 16. Dispensing system 60 may be configured in some embodiments to dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Figure 4:
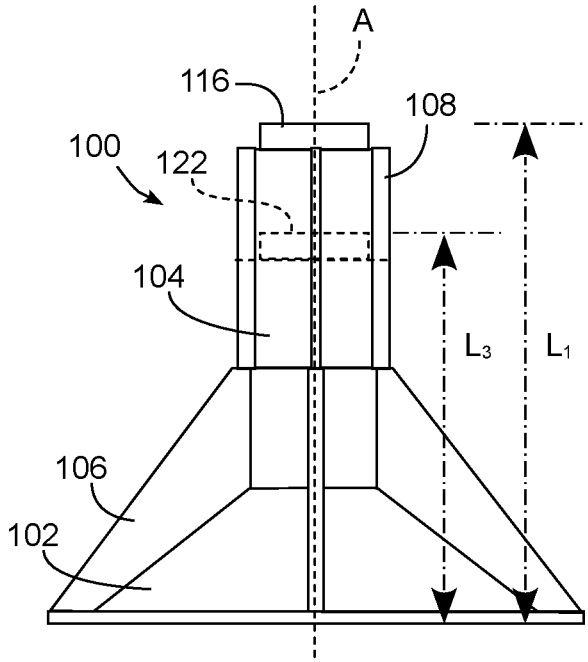
FIG. 4 is a side elevational view of an example embodiment of a biased variable length agitator capable of being used in the laundry washing machine of FIG. 1, and configured in a first configuration.
Figure 5:
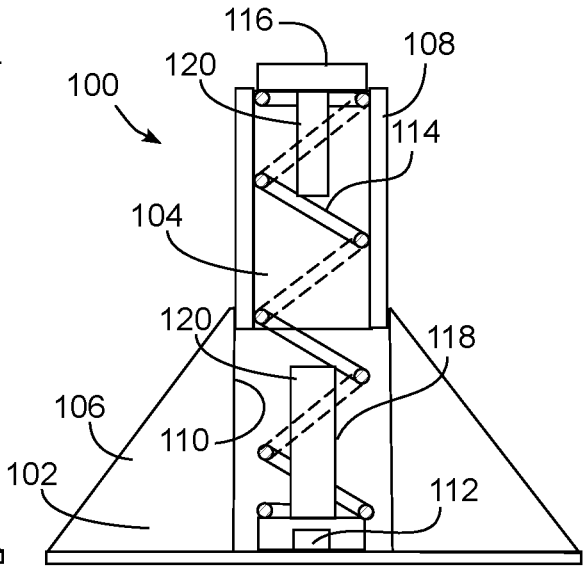
FIG. 5 is a cross-sectional view of the biased variable length agitator of FIG. 4.
Figure 6:
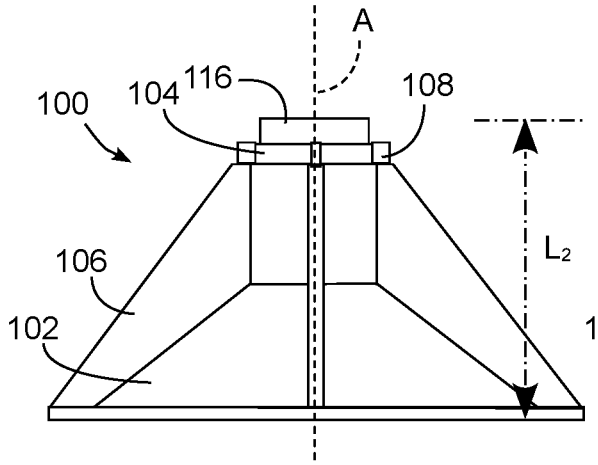
FIG. 6 is a side elevational view of the biased variable length agitator of FIG. 4, and configured in a second configuration.
Figure 7:
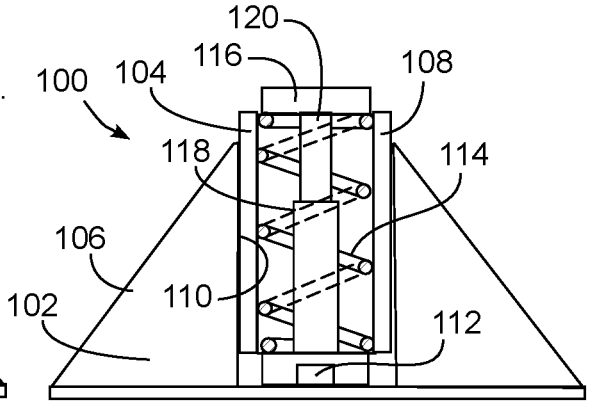
FIG. 7 is a cross-sectional view of the biased variable length agitator of FIG. 6.

Now turning to FIGS. 4-7, an example implementation of a variable length agitator 100 is illustrated, including a first, base member 102 and a second, tower member 104. Base member 102 may include one or more vanes or fins 106, and tower member 104 may include one or more vanes or fins 108, each of which configured to agitate a load and/or a wash fluid, and each of which having various configurations suitable for doing so, as will be appreciated by those of ordinary skill having the benefit of the instant disclosure. Agitator 100 may be configured into at least first and second configurations that respectively provide first and second lengths for the agitator 100 along an axis of rotation A. FIGS. 4 and 5, for example, illustrate a first, extended configuration that provides a first length $L_1$ along axis of rotation A, while FIGS. 6 and 7 illustrate a second, retracted configuration that provides a second length L2 along axis rotation A.

Moreover, as illustrated in FIGS. 5 and 7, tower member 104 is movable along axis of rotation A within a channel 110 defined within base member 102, and agitator 100 is rotated about axis of rotation A by a drive system (not shown in FIGS. 4-7) that couples to agitator 100 through a coupling 112.

Furthermore, as is also illustrated in FIGS. 5 and 7, agitator 100 includes a bias mechanism 114, e.g., a coiled compression spring, that biases the agitator to the first, extended configuration (illustrated in FIGS. 4-5). While a coiled compression spring is illustrated in FIGS. 5 and 7, it will be appreciated that various other types of bias mechanisms may be used in other designs, e.g., including but not limited to extension springs, torsion springs, leaf springs, gas or fluid springs, etc. Moreover, in other designs, a bias mechanism may be used to bias the agitator to a second (or other) configuration, and in some instances, a bias mechanism may be used to bias an agitator to multiple different positions (e.g., so that when a user moves the agitator between two configurations, the agitator is biased to one configuration until a certain point, and then the bias is applied to the other configuration). Furthermore, in some implementations, it may also be desirable to utilize a damping mechanism (not shown in FIGS. 4-7) to moderate a maximum speed at which the agitator may transition between different configurations as a result of the bias supplied by the bias mechanism.

In addition, a locking mechanism 116 may be used to lock the agitator 100 in one or both of the first, extended and second, retracted configurations. Locking mechanism 116, in particular, is used to selectively lock the agitator in one or more of its configurations, such that, when locked, relative movement between the base and tower members 102, 104 along axis of rotation A is inhibited, while when unlocked, relative movement between the base and tower members 102, 104 is permitted, thereby enabling a user to manually reconfigure the agitator into a different configuration. As will also become more apparent below, the locking mechanism may be capable of being automatically locked and/or unlocked (e.g., in response to movement to a predetermined position), or may be capable of being manually locked and/or unlocked (thus requiring user manipulation of the locking mechanism to lock and/or unlock the locking mechanism).

For example, in one example implementation, locking mechanism 116 is configured to lock the agitator in the second, retracted configuration by threading together a pair of threaded members 118, 120 respectively coupled to base member 102 and tower member 104, e.g., through manual rotational movement by the user about axis of rotation A. Thus, to lock the agitator in the second configuration, the user pushes down on tower member 104 until threaded members 118, 120 come into contact with one another, and then rotates threaded member 120 in a clockwise direction to engage the threaded members 118, 120 with one another and thereby secure the agitator in the second configuration. Then, through rotation of threaded member 120 in a counterclockwise direction, threaded members 118, 120 will disengage from one another, and the bias of bias mechanism 114 will automatically return the agitator to the first configuration once released by the user.

It will also be appreciated that while FIGS. 4-7 illustrate an agitator 100 configurable in two configurations, an agitator may also support one or more intermediate configurations, such as the configuration illustrated in phantom at 122 in FIG. 4 and providing a length of $L_3$, such that three or more different configurations, and thus three or more lengths along the axis of rotation, may be supported in some embodiments.

Now turning to FIGS. 8-12, it will be appreciated that a wide variety of different locking mechanisms may be used in different embodiments, providing automatic and/or manual locking and/or unlocking, and using various types of user manipulations, e.g., twisting, rotating, pushing, pulling, etc.

Figure 8:
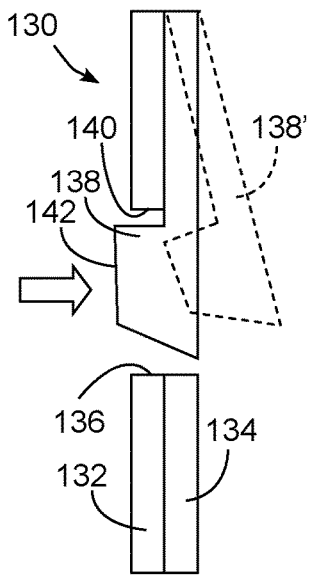
FIG. 8 is a functional cross-sectional view of an example embodiment of a locking mechanism suitable for use in a biased variable length agitator consistent with the invention.

FIG. 8, for example, illustrates a locking mechanism 130 capable of locking first and second members 132, 134 (e.g., where first member 132 is a base member and second member 134 is a tower member) in an agitator in a predetermined configuration. In this embodiment, members 132, 134 are movable relative to one another (e.g., in a substantially vertical direction) when locking mechanism 130 is in an unlocked state, but are restricted from relative movement when locking mechanism 130 is in a locked state.

In this embodiment, member 132 includes an aperture 136, and locking mechanism 130 includes a latch member 138 defined on member 134 that engages with a lip 140 defined on aperture 136 to restrict relative movement between members 132, 134. Latch member 138 is normally biased towards the position illustrated in FIG. 8, e.g., as a result of being integrally molded with member 134 and formed of an elastic material such as a molded polymer, but is deflectable to the position represented at 138', e.g., as a result of pressing on an actuation surface 142, such that latch member 138 disengages from lip 140 and permits relative movement between members 132, 134. It will also be appreciated that, at least during a portion of the range of relative movement between members 132, 134, latch member 138 may ride along a facing surface of member 132, and may be deflected inwardly as illustrated at 138'. Furthermore, in some embodiments, locking mechanism 130 may automatically engage when members 132, 134 are moved into the relative positions illustrated in FIG. 8, with outer surface 142 of latch member 138 aligning with aperture 136.

While latch member 138 is illustrated as an integrally-formed component of member 134, it will be appreciated that in other embodiments, latch member 138 may be a separate component and may be secured to member 134 through various mechanisms, and may be formed of other materials having sufficient elasticity, e.g., various metals or composite materials. Various geometries may also be used in other embodiments, and may include, for example, ramped surfaces suitable for deflecting latch member 138 when member 134 moves from a relative position where latch member 138 does not face member 132 to a relative position where latch member 138 does face member 132.

Figure 9:
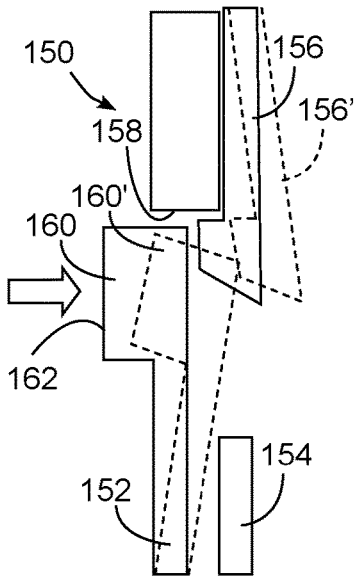
FIG. 9 is a functional cross-sectional view of another example embodiment of a locking mechanism suitable for use in a biased variable length agitator consistent with the invention.

FIG. 9 illustrates another locking mechanism 150 capable of locking first and second members 152, 154 (e.g., where first member 152 is a base member and second member 154 is a tower member) in an agitator in a predetermined configuration. In this embodiment, members 152, 154 are movable relative to one another (e.g., in a substantially vertical direction) when locking mechanism 150 is in an unlocked state, but are restricted from relative movement when locking mechanism 150 is in a locked state.

In this embodiment, member 154 includes a latch member 156 that is similar to latch member 138 of FIG. 8, and that is normally biased to engage a lip 158 on member 152 to restrict relative movement between members 152, 154. Latch member 156 is also deflectable to the position represented at 156' to disengage from lip 158 and permit relative movement between members 152, 154. However, rather than requiring a user to press directly on latch member 156, member 152 includes an actuator member 160 having an actuation surface 162 that may be pressed by a user to cause actuator member 160 to deflect to the position illustrated at 160', resulting in contact between actuator member 160 and latch member 156 to disengage latch member 156 from lip 158 and thereby release locking mechanism 150. As with latch member 138, each of latch member 156 and actuator member 160 may be formed in a number of different manners in different embodiments, e.g., as integrally-molded components of members 152, 154, as separate components secured to members 152, 154 through various mechanisms, and/or formed of other materials having sufficient elasticity.

Figure 10:
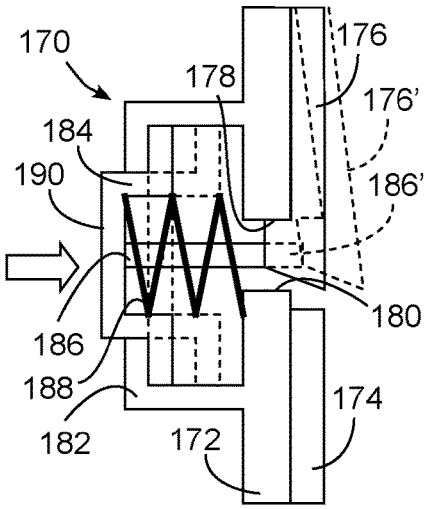
FIG. 10 is a functional cross-sectional view of yet another example embodiment of a locking mechanism suitable for use in a biased variable length agitator consistent with the invention.

FIG. 10 illustrates another locking mechanism 170 capable of locking first and second members 172, 174 (e.g., where first member 172 is a base member and second member 174 is a tower member) in an agitator in a predetermined configuration. In this embodiment, members 172, 174 are movable relative to one another (e.g., in a substantially vertical direction) when locking mechanism 170 is in an unlocked state, but are restricted from relative movement when locking mechanism 170 is in a locked state.

In this embodiment, member 174 includes a latch member 176 that is similar to latch member 156 of FIG. 9, and that is normally biased to engage a lip 178 formed by an aperture 180 in member 172 to restrict relative movement between members 172, 174. Latch member 176 is also deflectable to the position represented at 176' to disengage from lip 178 and permit relative movement between members 172, 174. However, rather than utilizing an integrally-formed actuator member such as actuator member 160 of FIG. 9, member 172 includes a button assembly 182 including a depressible button 184 operating as an actuator member and including a post 186 that projects through aperture 180 and engages latch member 176, and having a spring or other bias mechanism 188 that biases the button to a disengaged position. With such a configuration, a user may press an actuation surface 190 of button 184 to cause post 186 to translate to the position illustrated at 186', resulting in contact between post 186 and latch member 176 to disengage latch member 176 from lip 178 and thereby release locking mechanism 170.

Figure 11:
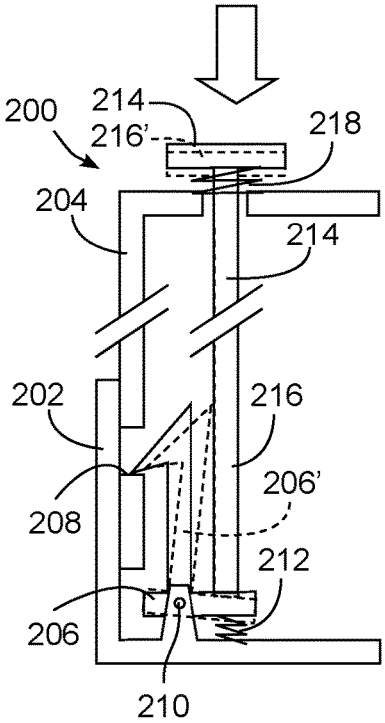
FIG. 11 is a functional cross-sectional view of another example embodiment of a locking mechanism suitable for use in a biased variable length agitator consistent with the invention.

FIG. 11 illustrates yet another locking mechanism 200 capable of locking first and second members 202, 204 (e.g., where first member 202 is a base member and second member 204 is a tower member) in an agitator in a predetermined configuration. In this embodiment, members 202, 204 are movable relative to one another (e.g., in a substantially vertical direction) when locking mechanism 200 is in an unlocked state, but are restricted from relative movement when locking mechanism 200 is in a locked state.

In this embodiment, member 202 includes a latch member 206 that engages a lip 208 formed on member 204. The latch member 206 may be mounted, for example, proximate a bottom of member 202, and may be pivotable about an axis 210 and normally biased to engage lip 208 by a spring or other bias mechanism 212 to restrict relative movement between members 202, 204. Latch member 206 is also pivotable to the position represented at 206' to disengage from lip 208 and permit relative movement between members 202, 204. However, rather than utilizing an actuator member disposed on member 202, member 204 includes a button assembly 214 including an actuator member 216 that extends through a top surface of member 204 to engage with latch member 206 when member 204 is in the relative position illustrated in FIG. 11, and that is biased by a spring or other bias mechanism 218 that biases the actuator member 216 to a disengaged position. With such a configuration, a user may press an actuation surface 220 on actuator member 216 to cause the actuator member to translate to the position illustrated at 216' and contact latch member 206, causing latch member 206 to pivot to the position illustrated at 206' and disengage latch member 206 from lip 208, thereby releasing locking mechanism 200.

Figure 12:
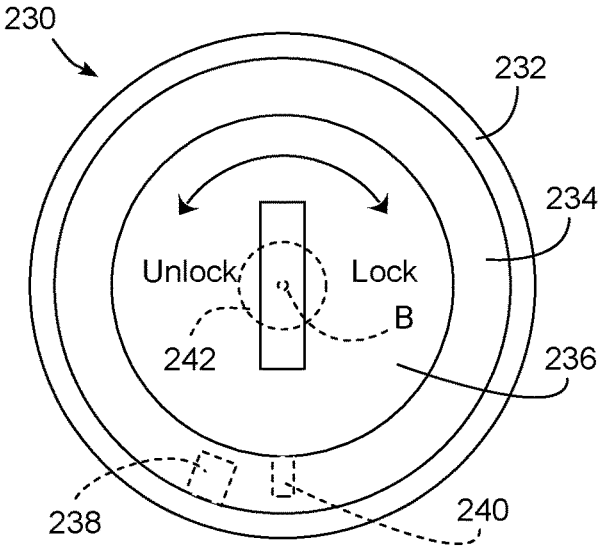
FIG. 12 is a top plan view of another example embodiment of a locking mechanism suitable for use in a biased variable length agitator consistent with the invention.

FIG. 12 next illustrates from above another locking mechanism 230 capable of locking first and second members 232, 234 (e.g., where first member 232 is a base member and second member 234 is a tower member) in an agitator in a predetermined configuration. In this embodiment, members 232, 234 are movable relative to one another along an axis of rotation B for the agitator when locking mechanism 230 is in an unlocked state, but are restricted from relative movement along axis of rotation B when locking mechanism 230 is in a locked state.

In this embodiment, a rotatable actuator 236 is disposed on a top of member 234 and is rotatable about the axis of rotation B between unlocked and locked configurations. Corresponding tabs 238, 240 on members 232, 234 are used to selectively restrict relative movement between members 232, 234 when the tabs are angularly aligned relative to axis of rotation B. In some embodiments, for example, where the agitator is biased to an extended configuration, tabs 238 and 240 may be configured to lock the agitator in a retracted configuration when the tabs are angularly aligned and tab 240 is disposed at a lower elevation than tab 238, such that tab 238 restricts movement of tab 240 (and thus member 234) towards the extended configuration. When the tabs are not angularly aligned (as is illustrated in FIG. 12), relative movement between members 232, 234 is otherwise permitted.

Thus, through rotation of rotatable actuator 236, locking mechanism 230 may be selectively locked (through clockwise rotation) or unlocked (through counter-clockwise rotation) to either restrict or permit relative movement between members 232, 234.

It will be appreciated that rotation of rotatable actuator 236 may be restricted in some embodiments to a limited range of angles, e.g., such that clockwise rotation beyond one in which the tabs 238, 240 are angularly aligned, is restricted. In addition, in some embodiments it may be desirable to bias the rotatable actuator 236, e.g., to the locked configuration, such that tabs 238, 240 will automatically engage with one another when members 232, 234 are moved to a predetermined relative position, and thereby automatically engage locking mechanism 230. In other embodiments, rotatable actuator 236 may be biased to the unlocked configuration.

Figure 13:
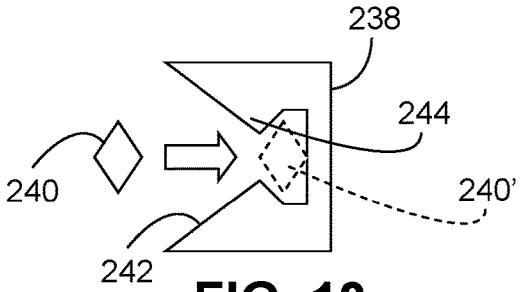
FIG. 13 is a functional view of an example tab arrangement capable of being used with the locking mechanism of FIG. 12.

Further, in some embodiments it may be desirable to include a damping mechanism, e.g., an air cylinder 242, to restrict the maximum rate of relative movement between members 232, 234. It may also be desirable to position tabs 238, 240 to lock the members 232, 234 in an extended configuration, or to include multiple tabs 238 and/or multiple tabs 240 to support locking at multiple configurations (e.g., at both extended and retracted configurations). It will also be appreciated that the use of the term "tab" also encompasses other structures that effectively restrict relative movement between members 232, 234 along axis of rotation B when tabs 238, 240 are angularly aligned. In one non-limiting embodiment, for example, and as illustrated in FIG. 13, tab 238 may include various features to both restrict rotation of rotatable actuator 236 and to assist in guiding tab 240 into engagement with tab 238. Specifically, tab 238 is generally "C" shaped, such that rotation of tab 240 beyond the position represented at 240' is restricted when tabs 238 and 240 are at similar elevations. In addition, tab 238 includes angled surfaces 242 that serve to guide tab 240 into engagement with tab 238 when tabs 238, 240 are elevationally-offset from one another. Furthermore, tab 238 also may include one or more detents 244 that resist rotation of rotatable actuator 236 from the locked configuration to the unlocked configuration to assist in maintaining the rotatable actuator 236 in the locked configuration.

It will be appreciated that an innumerable number of other structures and configurations, which utilize various mechanisms for pulling, pushing, twisting, rotating, etc. an actuator and/or an entire agitator member to lock or unlock multiple agitator members in a fixed relative position along an axis of rotation of an agitator may be used in other embodiments. Therefore, the invention is not limited to the specific types of locking mechanisms disclosed herein.

Figure 14:
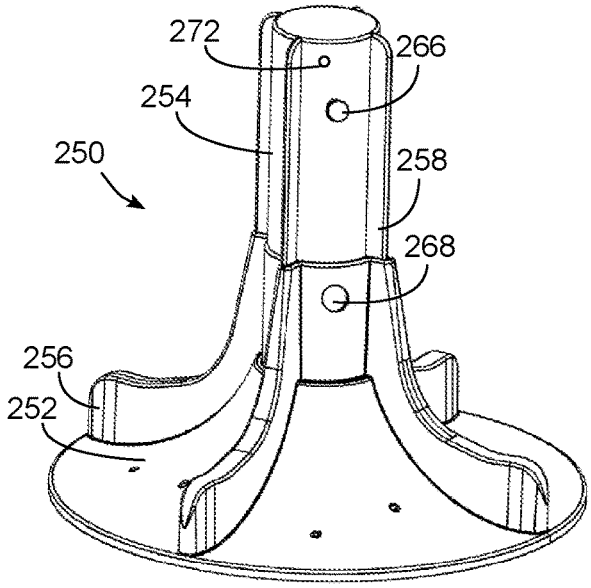
FIG. 14 is a perspective view of another example embodiment of a biased variable length agitator capable of being used in the laundry washing machine of FIG. 1, and configured in a first configuration.
Figure 15:
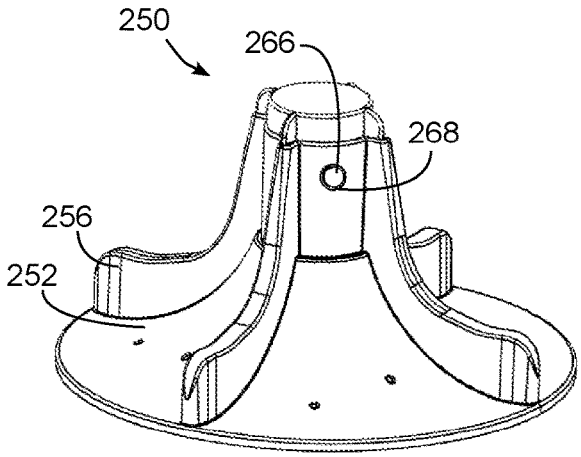
FIG. 15 is a perspective view of the biased variable length agitator of FIG. 4, and configured in a second configuration.
Figure 16:
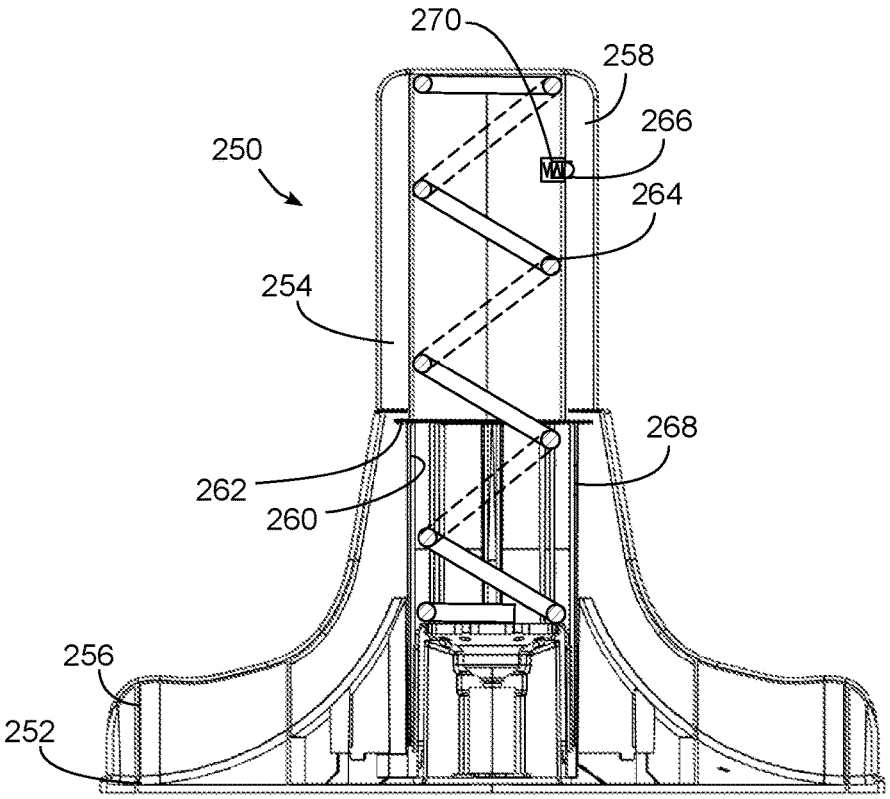
FIG. 16 is a cross-sectional view of the biased variable length agitator of FIG. 13.

FIGS. 14-16 next illustrate one particular embodiment of an agitator 250 suitable for use in some embodiments, and including a base member 252 and tower member 254, each respectively having a plurality of blades or fins 256, 258, and with agitator 250 configurable in each of extended (FIG. 14) and retracted (FIG. 15) configurations. As illustrated in FIG. 16, tower member 254 is slidably received in a channel 260 in base member 252, and a flange 262 restricts full removal of tower member 254 from channel 260, beyond the extended configuration illustrated in the figure. A spring 264 serves as a bias mechanism to bias the agitator towards the extended configuration.

A locking mechanism for agitator 250 is defined by a retractable button 266 on tower member 254 that is selectively received in an aperture 268 in base member 252 when the agitator is in the retracted configuration (FIG. 15). As illustrated in FIG. 16, button 266 is biased by a spring 270 to extend from a surface of tower member, and may be domed or otherwise inclined such that when tower member 254 is pushed down towards the retracted configuration, button 266 will recess into tower member 254 when it engages the sidewall of channel 260 until it aligns with aperture 268, at which point the spring 270 will extend the button to lock into aperture 268 and maintain the agitator in the retracted configuration. To release the locking mechanism and restore the agitator to the extended configuration, a user may depress button 266 (e.g., an actuation surface thereof), thereby disengaging the button from aperture 268 and allowing the tower member 254 to extend as a result of the bias applied by spring 264.

Thus, in this embodiment, a transition from the extended to the retracted configuration may be achieved merely by pressing downwardly on tower member 254 until button 266 aligns with aperture 268. Conversely, a transition from the retracted configuration to the extended configuration may be achieved merely by depressing button 266. It should be noted that, while in the embodiment of FIGS. 14-16 no locking mechanism is used to lock the agitator in the extended configuration, such a locking mechanism could be incorporated into an agitator in other embodiments. It may also be desirable in some embodiments to include one or more drainage holes 272 (FIG. 14) to inhibit air capture by the tower member that might otherwise cause the tower member to be buoyant when submerged in wash fluid.

It will therefore be appreciated that the use of a bias mechanism may be beneficial in many embodiments, particularly in top-load washing machines where a user may be required to reach into the bottom of the wash tub in order to reconfigure the agitator. In the absence of a bias mechanism that biases the agitator to an extended configuration, for example, the user might otherwise be required to both release the locking mechanism while simultaneously pulling the tower member upwardly into the extended configuration, operations that may require two hands to complete, and that may additionally be further complicated due to the fact that the agitator is near the bottom of the wash tub. In many of the designs described above, however, a single operation by a single hand of a user may be sufficient to release a locking mechanism and enable a bias mechanism to automatically lift the tower member into the extended configuration. Similar advantages may also exist in some embodiments when locking an agitator into a retracted configuration, when locking and/or unlocking an agitator in an extended configuration, or when locking and/or unlocking an agitator in an intermediate configuration.

A variable length agitator as described herein may be useful, for example, to retract the agitator to increase the available volume within a wash tub, or to accommodate loads where an agitator may not be useful or may not be desired, e.g., delicates, bulky items such as bed linens, etc., or in any other situations where a fully extended agitator is not desired.

Various additional modifications may be made to the illustrated embodiments consistent with the invention. Therefore, the invention lies in the claims hereinafter appended.

What is claimed is:

1. A laundry washing machine, comprising:

a housing;

a wash tub disposed within the housing; and a variable length agitator disposed within the wash tub and configured to rotate about an axis of rotation, the variable length agitator being configurable in at least first and second configurations that respectively provide first and second lengths for the variable length agitator along the axis of rotation, and the variable length agitator including a bias mechanism configured to bias the variable length agitator towards the first configuration, wherein the variable length agitator includes first and second members, the first member includes at least one fin configured to agitate a load during a wash cycle and is moveable relative to the second member along the axis of rotation to vary the length of the variable length agitator along the axis of rotation, and the second member includes a channel that receives at least a portion of the first member and at least a portion of the at least one fin when the variable length agitator is in one of the first and second configurations.

2. The laundry washing machine of claim 1, wherein the variable length agitator is further configurable in a third configuration that provides a third length for the variable length agitator along the axis of rotation that is intermediate the first and second lengths.

3. The laundry washing machine of claim 1, wherein the axis of rotation is substantially vertical and the laundry washing machine is a top-load laundry washing machine.

4. The laundry washing machine of claim 1, wherein the first length is longer than the second length.

5. The laundry washing machine of claim 1, wherein the first length is shorter than the second length.

6. The laundry washing machine of claim 1, wherein the bias mechanism comprises a spring disposed within an interior of the variable length agitator.

7. The laundry washing machine of claim 6, wherein the spring is a coiled compression spring.

8. The laundry washing machine of claim 1, wherein the variable length agitator further comprises a locking mechanism configured to selectively lock the variable length agitator in at least one of the first and second configurations.

9. The laundry washing machine of claim 8, wherein the locking mechanism is configured to selectively lock the variable length agitator in the second configuration.

10. The laundry washing machine of claim 9, wherein the variable length agitator is unlockable in the first configuration.

11. The laundry washing machine of claim 8, wherein the locking mechanism is configured to selectively lock the variable length agitator in the first configuration.

12. The laundry washing machine of claim 8, wherein the locking mechanism is configured to selectively lock the variable length agitator in each of the first and second configurations.

13. The laundry washing machine of claim 8, wherein the locking mechanism is configured to automatically engage when the first and second members are moved to a predetermined relative position.

14. The laundry washing machine of claim 13, wherein the locking mechanism is configured to release in response to user actuation of the locking mechanism.

15. The laundry washing machine of claim 8, wherein the locking mechanism includes a latch member disposed on one of the first and second members and a lip disposed on the other of the first and second members, and wherein the latch member and the lip are configured to engage with one another and restrict relative movement between the first and second members when the first and second members are in a predetermined relative position.

16. The laundry washing machine of claim 15, wherein the latch member includes an actuation surface that, when manipulated by a user, releases the latch member from the lip to permit relative movement between the first and second members.

17. The laundry washing machine of claim 15, wherein the locking mechanism further includes an actuator member including an actuation surface that, when manipulated by a user, causes the actuator member to release the latch member from the lip to permit relative movement between the first and second members.

18. The laundry washing machine of claim 8, wherein the locking mechanism includes a rotatable actuator configured to rotate about the axis of rotation to selectively lock and/or unlock the locking mechanism.

19. The laundry washing machine of claim 1, wherein the at least one fin includes a first fin, the second member includes a second fin configured to agitate the load during the wash cycle, and the channel extends into the second fin such that at least a portion of the first fin is received in a portion of the channel extending into the second fin when the variable length agitator is in the one of the first and second configurations.

20. The laundry washing machine of claim 1, further comprising a damping mechanism coupled between the first and second members and configured to limit a rate of relative movement between the first and second members.

21. The laundry washing machine of claim 1, wherein the first member is a tower member and the second member is a base member.

22. A variable length agitator configured to rotate about an axis of rotation in a wash tub of a laundry washing machine, comprising:

first and second members, wherein the first member is moveable relative to the second member along the axis of rotation to selectively configure the variable length agitator in at least first and second configurations that respectively provide first and second lengths for the variable length agitator along the axis of rotation; and a bias mechanism configured to bias the variable length agitator towards the first configuration;

wherein the first member includes at least one fin configured to agitate a load during a wash cycle, and the second member includes a channel that receives at least a portion of the first member and at least a portion of the at least one fin when the variable length agitator is in one of the first and second configurations.

* * * * *